US005626282A

United States Patent [19]

Lewis

[11] Patent Number: 5,626,282

[45] Date of Patent: May 6, 1997

[54] ENVELOPE SEALING SYSTEM

[76] Inventor: Gerald C. Lewis, 120-T W. Barnes St., P.O. Box 233, Centralia, Mo. 65240-0233

[21] Appl. No.: 567,914

[22] Filed: Dec. 6, 1995

[51] Int. Cl.[6] ..... B65D 27/16

[52] U.S. Cl. ..... 229/80

[58] Field of Search ..... 229/80, 80.5; 383/84, 383/86

[56] References Cited

U.S. PATENT DOCUMENTS

| | | | |
|---|---|---|---|
| 2,601,946 | 7/1952 | Heywood | 229/80 |
| 3,503,568 | 3/1970 | Galley | 229/80 X |
| 4,543,139 | 9/1985 | Freedman et al. | 383/86 X |

FOREIGN PATENT DOCUMENTS

| | | | |
|---|---|---|---|
| 2576877 | 8/1986 | France | 229/80 |
| 317932 | 1/1920 | Germany | 229/80 |
| 675709 | 9/1939 | Germany | 229/80 |
| 1916328 | 10/1969 | Germany | 229/80 |
| 2439101 | 5/1975 | Germany | 229/80 |

*Primary Examiner*—Jes F. Pascua

[57] ABSTRACT

An envelope sealing system adapted for use in association with an envelope including a lower pocket and an upper flap with strips of glue, the apparatus comprising: an adhesive band formed in an elongated generally rectangular configuration, the band including a sealant strip with an upper surface and a lower surface, each surface including adhesive material positioned thereupon, the band further including a peel off cover couple to its upper and lower surfaces, the peel off covers retaining the adhesive properties of the strip during storage, in an operative orientation the lower surface of an exposed sealant strip being coupled upon the glue strips of the upper flap of an envelope, an envelope being easily sealable after affixation of the sealant strips to the upper flap by simply folding the flap downward so that the upper surface of the sealant strips become adhesively affixed to the lower pocket of the envelope.

1 Claim, 2 Drawing Sheets

ENVELOPE SEALING SYSTEM

BACKGROUND OF THE INVENTION

1. Field of the Invention

The present invention relates to a envelope sealing system and more particularly pertains to sealing an envelope by affixing the adhesive apparatus over the existing glued portion of an envelope.

2. Description of the Prior Art

The use of self-sealing envelopes is known in the prior art. More specifically, self-sealing envelopes heretofore devised and utilized for the purpose of sealing the flaps by manipulating the envelopes in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,759,643 to Canno a self-sealing envelope.

U.S. Pat. No. 4,055,295 to Cohn discloses a self-sealing envelope and method of making same.

U.S. Pat. No. 3,675,844 to Sorrell discloses an envelope with sealing means.

U.S. Pat. No. 5,201,982 to Schmidt discloses a method for producing self-sealing envelopes.

U.S. Pat. No. 4,932,791 to Vetter discloses an envelope closure seal and method.

Lastly, U.S. Pat. No. 4,983,047 to Netto discloses an envelope with closure and seal device.

In this respect, the envelope sealing system according to the present invention substantially departs from the conventional concepts and designs of the prior art, and in doing so provides an apparatus primarily developed for the purpose of sealing an envelope by affixing the adhesive apparatus over the existing glued portion of an envelope.

Therefore, it can be appreciated that there exists a continuing need for a new and improved envelope sealing system which can be used for sealing an envelope by affixing the adhesive apparatus over the existing glued portion of an envelope. In this regard, the present invention substantially fulfills this need.

SUMMARY OF THE INVENTION

In view of the foregoing disadvantages inherent in the known types of self-sealing envelopes now present in the prior art, the present invention provides an improved envelope sealing system. As such, the general purpose of the present invention, which will be described subsequently in greater detail, is to provide a new and improved envelope sealing system and method which has all the advantages of the prior art and none of the disadvantages.

To attain this, the present invention essentially comprises a new and improved envelope sealing system comprising, in combination: an envelope comprising a generally rectangular shaped lower pocket and a triangular shaped upper flap, the upper flap having two angled side edges meeting to form a point, a strip of glue being positioned adjacent to each side edge of the upper flap; an adhesive band formed in an elongated generally rectangular configuration, equidistantly spaced perforations separating the adhesive band into segments, the band being foldable along the perforations to permit easy storage of the apparatus, the band including a sealant strip formed in an elongated rectangular configuration with an upper surface and a lower surface, each surface including adhesive material positioned thereupon, the band further including a peel off cover couple to its upper and lower surfaces, the peel off covers retaining the adhesive properties of the strip during storage, each segment of the band being appropriately sized and shaped so that the lower surface of an exposed sealant strip may be easily coupled upon the glue strips of the upper flap, the envelope being easily sealable after affixation of the sealant strips to the upper flap by simply folding the flap downward so that the upper surface of the sealant strips become adhesively affixed to the lower pocket of the envelope.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved envelope sealing system which has all of the advantages of the prior art self-sealing envelopes and none of the disadvantages.

It is another object of the present invention to provide a new and improved envelope sealing system which may be easily and efficiently manufactured and marketed.

It is further object of the present invention to provide a new and improved envelope sealing system which is of durable and reliable constructions.

An even further object of the present invention is to provide a new and improved envelope sealing system which is susceptible of a low cost of manufacture with regard to both materials and labor, and which accordingly is then susceptible of low prices of sale to the consuming public, thereby making such envelope sealing system economically available to the buying public.

Still yet another object of the present invention is to provide a new and improved envelope sealing system which provides in the apparatuses and methods of the prior art some of the advantages thereof, while simultaneously overcoming some of the disadvantages normally associated therewith.

Still another object of the present invention is to sealing an envelope by affixing the adhesive apparatus over the existing glued portion of an envelope.

Lastly, it is an object of the present invention to provide a new and improved envelope sealing system adapted for use in association with an envelope including a lower pocket and an upper flap with strips of glue, the apparatus comprising: an adhesive band formed in an elongated generally rectangular configuration, the band including a sealant strip with an upper surface and a lower surface, each surface including adhesive material positioned thereupon, the band further including a peel off cover couple to its upper and lower surfaces, the peel off covers retaining the adhesive properties of the strip during storage, in an operative orientation the lower surface of an exposed sealant strip being coupled upon the glue strips of the upper flap of an envelope, an envelope being easily sealable after affixation of the sealant strips to the upper flap by simply folding the flap downward so that the upper surface of the sealant strips become adhesively affixed to the lower pocket of the envelope.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
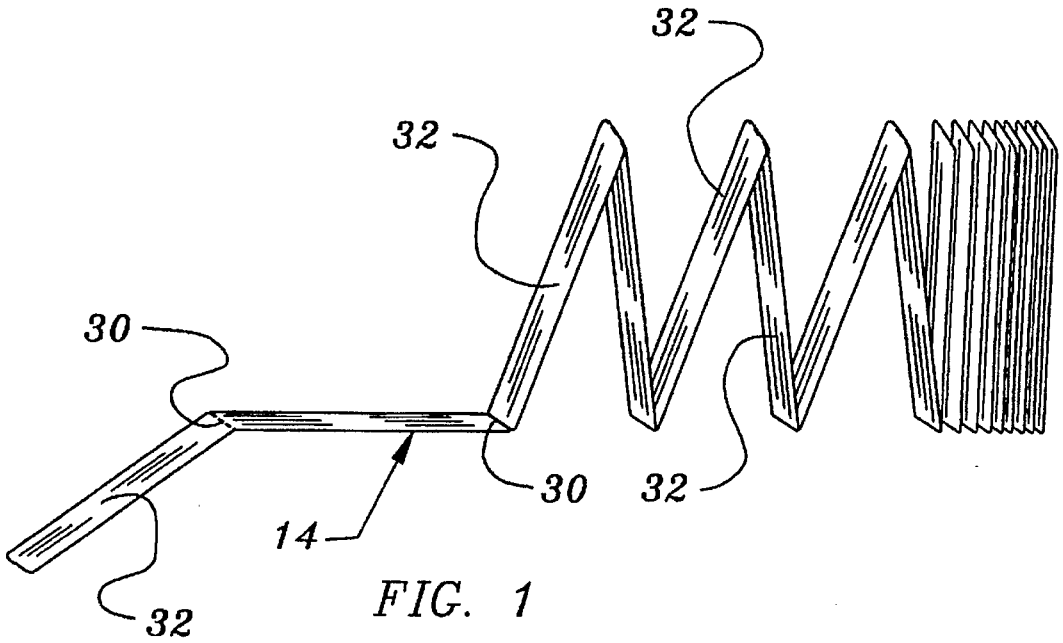
FIG. 1 is a perspective illustration of the adhesive band positioned in a folded orientation.

With reference now to the drawings, and in particular to FIG. 1 thereof, the preferred embodiment of the new and improved envelope sealing system embodying the principles and concepts of the present invention and generally designated by the reference numeral 10 will be described.

The present invention, the envelope sealing system 10 is comprised of a plurality of components. Such components in their broadest context include an envelope 12, a band 14, a sealant strip 16 and two peel off covers 18. Such components are individually configured and correlated with respect to each other so as to attain the desired objective.

More specifically, the envelope 12 comprises a generally rectangular shaped lower pocket 20 and a triangular shaped upper flap 22. A letter or other article to be mailed is positionable within the lower pocket. The upper flap has two angled side edges 24 which meet to form a point 26. A strip of glue is positioned adjacent to each side edge of the upper flap. The user may lick the glue or use some other dampening means to seal the envelope. However, licking the glue leaves a bad taste in the user's mouth, and other dampening means are generally very messy. The present invention provides a clean and efficient alternative to the above mentioned sealing methods. Note FIG. 1.

Figure 2:
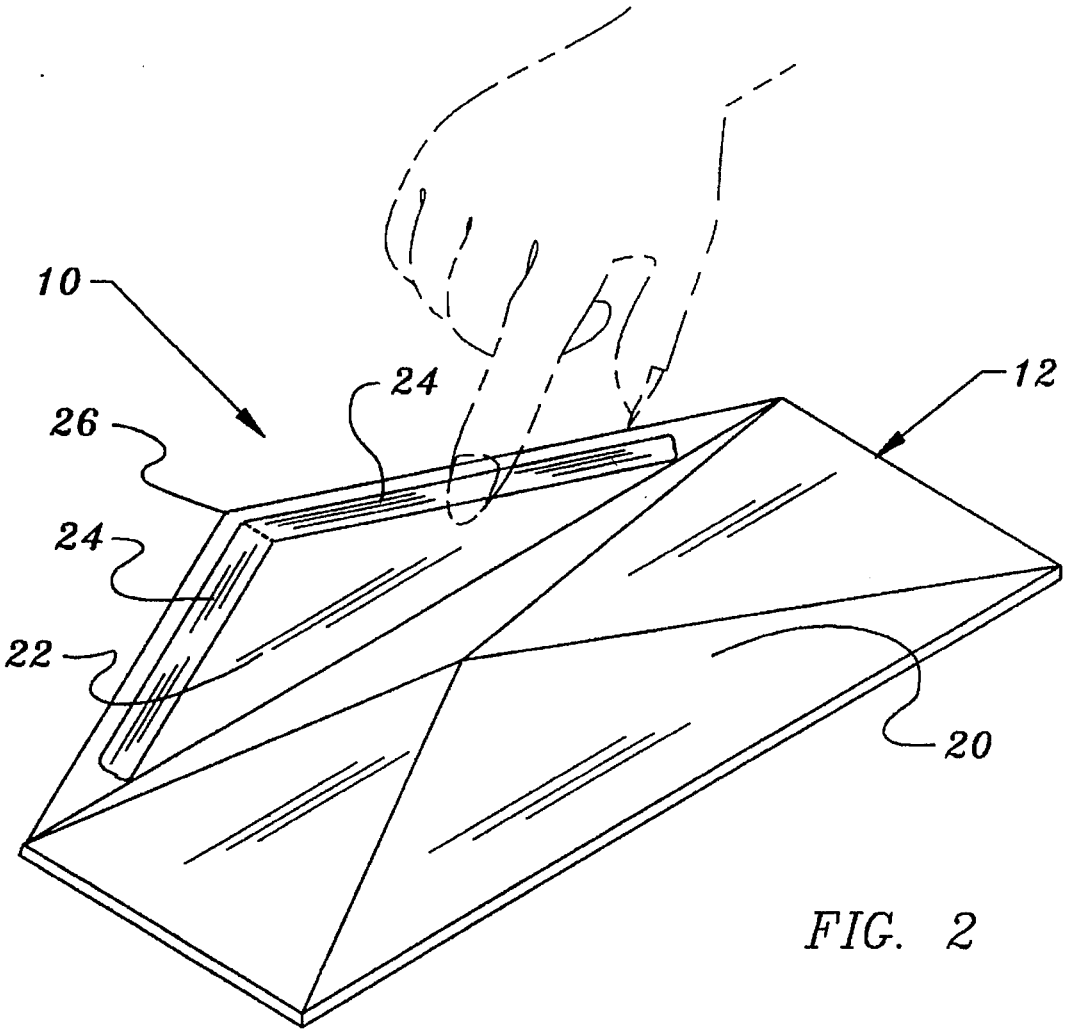
FIG. 2 is a perspective view of the preferred embodiment of the envelope sealing system constructed in accordance with the principles of the present invention.

An adhesive band 14 is formed in an elongated generally rectangular configuration. The adhesive band is manufactured by submersing a planar strip in liquid adhesive material. Sealant strips are then placed upon the upper and lower surfaces of the adhesive band. Equidistantly spaced perforations 30 separate the adhesive band into individual segments 32 the perforations are formed by cutting small holes in the adhesive band at predetermined intervals. The band is foldable along the perforations to permit easy storage of the apparatus. The perforations also permit easy tearing of the band into individual segments. In varying embodiments of the apparatus the perforations are separated by different distances to accommodate differently sized envelopes. Note FIG. 1 and 2.

Figure 3:
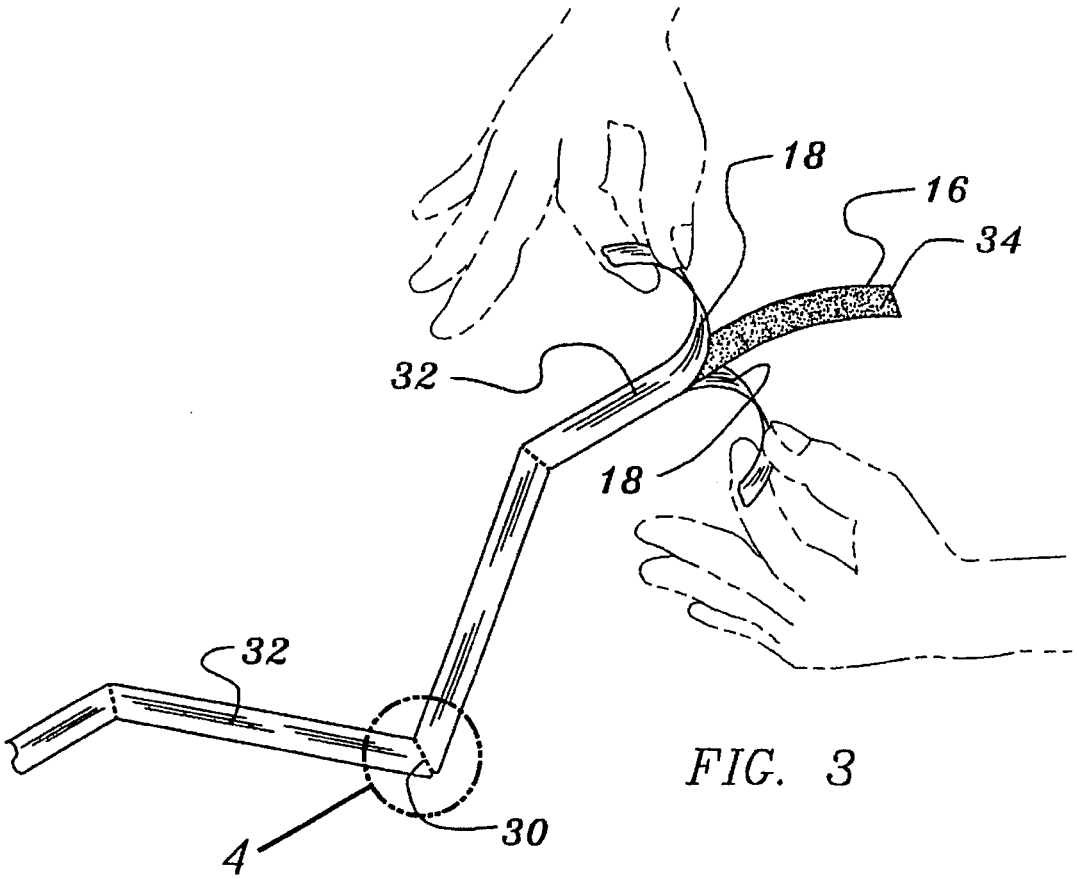
FIG. 3 is a perspective illustration of the adhesive band disclosing its composite sealant strip and peel off covers.

The band includes a sealant strip 16 formed in an elongated rectangular configuration with an upper surface and a lower surface. Each surface includes adhesive material 34 positioned upon it. The adhesive material is very sticky and is adapted to permanently secure the upper flap of the envelope to the lower pocket of the envelope. The adhesive properties of the adhesive material are stronger than the adhesive properties of the glue. Note FIGS. 1–3.

Figure 4:
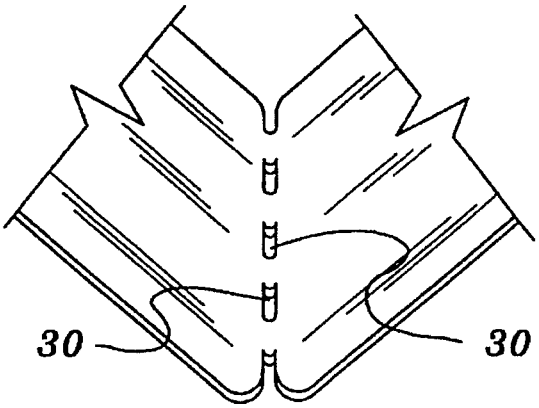
FIG. 4 is an enlarged perspective view taken along section line 4 of FIG. 3 and illustrating a perforation of the band.
Figure 5:
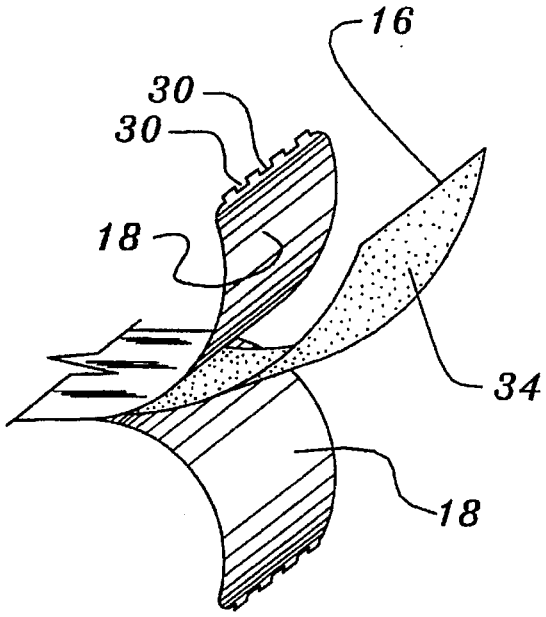
FIG. 5 is an enlarged perspective illustration of the adhesive sealant strip and peel off cover of the apparatus.

The band further includes a peel off cover 18 coupled to its upper and lower surfaces. The peel off covers retain the adhesive properties of the strip during storage. In the preferred embodiment the peel off covers are fabricated of a plastic material. In an operative orientation a user simply peels off the covers using her index finger and thumb. Each segment of the band is appropriately sized and shaped so that the lower surface of an exposed sealant strip may be easily coupled upon the glue strips of the upper flap. As previously mentioned, in varying embodiments of the apparatus the perforations are separated by different distances thereby defining differently sized segments. The envelope is easily sealable after affixation of the sealant strips to the upper flap by simply folding the flap downward so that the upper surface of the sealant strips become adhesively affixed to the lower pocket of the envelope. Note FIGS. 3–5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved envelope sealing system comprising, in combination:

an envelope comprising a generally rectangular shaped lower pocket and a triangular shaped upper flap, the upper flap having two angled side edges meeting to form a point, a strip of glue being positioned adjacent to each side edge of the upper flap;

an adhesive band formed in an elongated generally rectangular configuration, equidistantly spaced perforations separating the adhesive band into segments, the band being foldable along the perforations to permit easy storage of the envelope sealing system, the band including a sealant strip formed in an elongated rectangular configuration with an upper surface and a lower surface, each surface including adhesive material positioned thereupon, the band further including a peel off cover couple to its upper and lower surfaces, the peel off covers retaining the adhesive properties of the strip during storage, each segment of the band being appropriately sized and shaped so that the lower surface of an exposed sealant strip may be easily coupled upon the glue strips of the upper flap, the envelope being easily sealable after affixation of the sealant strips to the upper flap by simply folding the flap downward so that the upper surface of the sealant strips become adhesively affixed to the lower pocket of the envelope.

* * * * *